US009096351B2

(12) United States Patent
Exner et al.

(10) Patent No.: US 9,096,351 B2
(45) Date of Patent: Aug. 4, 2015

(54) RECLOSABLE PACKAGE

(71) Applicant: Kraft Foods R&D, Inc., Deerfield, IL (US)

(72) Inventors: Ron Exner, Icking, DE (US); Olav Dagestad, Oslo (NO)

(73) Assignee: Kraft Foods R & D, Inc., Deerfield, IL (US)

( * ) Notice: Subject to any disclaimer, the term of this patent is extended or adjusted under 35 U.S.C. 154(b) by 0 days.

(21) Appl. No.: 13/948,749

(22) Filed: Jul. 23, 2013

(65) Prior Publication Data

US 2014/0016884 A1 Jan. 16, 2014

Related U.S. Application Data

(63) Continuation of application No. 11/862,796, filed on Sep. 27, 2007, now Pat. No. 8,596,867.

(30) Foreign Application Priority Data

Dec. 29, 2006 (EP) ..... 06027067

(51) Int. Cl.

| | |
|---|---|
| ***B65D 33/00*** | (2006.01) |
| ***B32B 7/12*** | (2006.01) |
| ***B65D 33/16*** | (2006.01) |
| ***B65D 75/58*** | (2006.01) |

(52) U.S. Cl.

CPC ..... *B65D 33/16* (2013.01); *B65D 75/5855* (2013.01); *B65D 2575/586* (2013.01)

(58) Field of Classification Search

CPC . B65D 33/20; B65D 75/5855; B65D 77/2096
USPC ..... 383/210–211; 428/355 AC, 343
See application file for complete search history.

(56) References Cited

U.S. PATENT DOCUMENTS

| | | | | |
|---|---|---|---|---|
| 2,714,562 | A * | 8/1955 | Hechtman | 428/462 |
| 2,778,171 | A | 1/1957 | Gerald | |
| 2,991,001 | A | 7/1961 | Hughes | |
| 3,154,239 | A | 10/1964 | Peter | |
| 3,578,622 | A * | 5/1971 | Kremer et al. | 524/464 |
| 3,608,707 | A | 9/1971 | Miller | |
| 4,399,249 | A | 8/1983 | Bildusas | |
| 4,572,377 | A | 2/1986 | Beckett | |
| 4,676,394 | A | 6/1987 | Hiersteiner | |
| 4,709,396 | A | 11/1987 | Voshall | |
| 4,709,397 | A | 11/1987 | Voshall | |
| 4,728,572 | A | 3/1988 | Davis | |
| 4,759,642 | A | 7/1988 | Van | |
| 4,785,940 | A | 11/1988 | Wilson | |
| 4,786,190 | A | 11/1988 | Van | |
| 4,859,521 | A | 8/1989 | Pike | |
| 4,898,280 | A | 2/1990 | Runge | |
| 4,902,142 | A | 2/1990 | Lammert | |
| 4,925,684 | A | 5/1990 | Simon | |
| 5,089,320 | A | 2/1992 | Straus | |
| 5,172,854 | A | 12/1992 | Epstein | |
| 5,174,659 | A | 12/1992 | Laske | |
| 5,308,666 | A | 5/1994 | Borchardt | |
| 5,382,472 | A * | 1/1995 | Yanidis et al. | 428/349 |
| 5,519,982 | A | 5/1996 | Herber | |
| 5,691,052 | A | 11/1997 | Jones | |
| 5,706,961 | A | 1/1998 | Morano | |
| 5,725,312 | A | 3/1998 | May | |
| 5,814,382 | A | 9/1998 | Yannuzzi | |
| 5,882,749 | A | 3/1999 | Jones | |
| 5,882,789 | A | 3/1999 | Jones | |
| 5,924,795 | A | 7/1999 | Thompson | |
| 5,993,962 | A | 11/1999 | Timm | |
| 6,012,844 | A | 1/2000 | Huseman | |
| D423,346 | S | 4/2000 | Froehlich | |
| 6,172,156 | B1 | 1/2001 | Lindquist | |
| 6,196,716 | B1 | 3/2001 | Geyer | |
| 6,244,748 | B1 | 6/2001 | Kasai | |
| 6,318,894 | B1 | 11/2001 | Derenthal | |
| 6,351,857 | B2 | 3/2002 | Slaon | |
| 6,371,644 | B1 | 4/2002 | Forman | |
| 6,389,651 | B2 | 5/2002 | Johnson | |
| 6,398,412 | B2 | 6/2002 | Wedi | |

(Continued)

FOREIGN PATENT DOCUMENTS

| | | | |
|---|---|---|---|
| DE | 20113173 | U1 | 10/2001 |
| DE | 102005013585 | A1 | 9/2006 |

(Continued)

OTHER PUBLICATIONS

"Annex to the Communication-Opposition", EP Publication No. 1939106, dated Jun. 13, 2013; 12 pages.
"Decision of the Opposition Division and Instruction" and "Druckexemplar in Opposition Procedure"; EP Publication No. 1939106, dated Jun. 13, 2013; 6 pages.
"Grounds for the Decision (Annex)-Opposition"; EP Publication No. 1939106, dated Jun. 13, 2013; 12 pages.
"Interlocutory Decision in Opposition Proceedings"; EP Publication No. 1939106, dated Jun. 13, 2013; 2 pages.
"Letter Regarding the Opposition Procedure and Claims"; EP Publication No. 1939106, dated Apr. 2, 2013; 22 pages.

(Continued)

*Primary Examiner* — Jes F Pascua
(74) *Attorney, Agent, or Firm* — Fitch, Even, Tabin & Flannery LLP

(57) ABSTRACT

A reclosable package for flood products had the following features:

a cold seal formed between a first and a second sealing portion, in which the bonding force of the cold seal to the first and the second sealing portion is greater than the bonding force within the cold seal, so that the cold seal is separated and partly adheres to the first, and partly adheres to the second sealing portion when the seal is opened or, a seal with an initial opening force of 2, preferably 2.5, to a 4 N/15 mm, and opening forces for one or more reclosings of 0.5 to 2 N/15 mm, preferably 1 to 1.5 N/15 mm.

10 Claims, No Drawings

(56) References Cited

U.S. PATENT DOCUMENTS

| | | | | |
|---|---|---|---|---|
| 6,461,044 | B1 | 10/2002 | Anderson | |
| 6,461,708 | B1 | 10/2002 | Dronzek | |
| 6,467,957 | B2 | 10/2002 | Yeager | |
| 6,502,986 | B1 | 1/2003 | Bensur | |
| D470,757 | S | 2/2003 | Espinel | |
| 6,743,451 | B2 | 6/2004 | Rasile | |
| 6,863,646 | B2 | 3/2005 | Kinigakis | |
| 6,884,207 | B2 | 4/2005 | Pokusa | |
| 6,991,375 | B2 | 1/2006 | Clune | |
| D541,667 | S | 5/2007 | Pokusa | |
| D541,668 | S | 5/2007 | Pokusa | |
| D541,669 | S | 5/2007 | Pokusa | |
| 7,235,294 | B2 * | 6/2007 | Story | 428/356 |
| 7,740,923 | B2 | 6/2010 | Exner | |
| 8,596,867 | B2 * | 12/2013 | Exner et al. | 383/210 |
| 2003/0103690 | A1 | 6/2003 | Schneider | |
| 2004/0106693 | A1 * | 6/2004 | Kauffman et al. | 522/184 |
| 2005/0031233 | A1 | 2/2005 | Varanese | |
| 2005/0041888 | A1 | 2/2005 | Matsuzawa | |
| 2005/0063619 | A1 | 3/2005 | Kinigakis | |
| 2005/0095436 | A1 * | 5/2005 | Story | 428/423.1 |
| 2007/0104395 | A1 | 5/2007 | Kinigakis | |
| 2008/0206417 | A1 | 8/2008 | Kirsch | |
| 2008/0223007 | A1 | 9/2008 | Friebe | |
| 2010/0178394 | A1 | 7/2010 | Exner | |
| 2010/0239721 | A1 | 9/2010 | Stoppello | |

FOREIGN PATENT DOCUMENTS

| | | | |
|---|---|---|---|
| EP | 0338304 | A2 | 10/1989 |
| EP | 1010632 | A1 | 6/2000 |
| EP | 1010638 | A1 | 6/2000 |
| EP | 1164087 | A2 | 12/2001 |
| EP | 1232960 | A2 | 8/2002 |
| EP | 1281623 | A1 | 2/2003 |
| EP | 1288139 | | 3/2003 |
| EP | 1460117 | A1 | 9/2004 |
| EP | 1676785 | A1 | 7/2006 |
| EP | 1714895 | | 10/2006 |
| EP | 2319765 | A1 | 5/2011 |
| JP | S6117066 | | 1/1986 |
| JP | S63011228 | | 1/1988 |
| JP | H01061073 | | 4/1989 |
| JP | 03-043361 | | 2/1991 |
| JP | 03-178436 | | 8/1991 |
| JP | 05221454 | | 8/1993 |
| JP | 05-295335 | | 11/1993 |
| JP | 06-065547 | | 3/1994 |
| JP | H06071453 | | 10/1994 |
| JP | 2002037279 | | 2/2002 |
| JP | 2003095285 | | 4/2003 |
| JP | 2005-212846 | | 8/2005 |
| JP | 2005-335118 | | 12/2005 |
| JP | 2006315385 | A | 11/2006 |
| WO | 9800471 | | 1/1998 |
| WO | 0058167 | A1 | 10/2000 |
| WO | 2005014406 | A2 | 2/2005 |
| WO | 2006100084 | A1 | 9/2006 |
| WO | 2006111177 | A1 | 10/2006 |

OTHER PUBLICATIONS

"Minutes of the Oral Proceedings (Opposition Division)—Conclusion of the Proceedings"; "Introduction of the Parties"; and "Annex to Communication"; EP Publication No. 1939106, dated Jun. 13, 2013; 11 pages.

Bentley, D.; About Cold Seal Adhesives, Paper, Film and Foil Converter, Jan. 1, 2006, Internet Printout; 4 pages.

D. Grondin; "Information About the Result of Oral Proceedings"; EP Publication No. 1939106, dated Apr. 30, 2013; 5 pages.

European Patent Office Extended European Search Report dated Mar. 5, 2007 for European Application No. 06122144.6, 8 pages.

Kuusipalo, J.; Re-sealing studies of cold seal latexes for paper based packages; Finnish Paper and Wood Journal Ltd., 2000, vol. 82, No. 3, pp. 189-192.

Notice of Opposition filed by Opponent BASF in the European Patent Office; EP Patent No. 1939106; dated Dec. 8, 2009; 6 pages.

Notice of Opposition filed by Opponent Cadbury in the European Patent Office; EP Patent No. 1939106; dated Dec. 3, 2009; 5 pages.

Notice of Opposition filed by Opponent Ritter in the European Patent Office; EP Patent No. 1939106; dated Nov. 26, 2009; 14 pages.

Official Notice of Rejection and English translation thereof, Japanese Patent Office dated Aug. 24, 2012; Japanese Patent Application No. 2007-249497; 11 pages.

Opposition Preliminary Opinion in the European Patent Office; EP Patent No. 1939106, EP Application No. EP06027067.5; dated Jan. 2, 2013; 4 pages.

Response to Notice of Opposition, dated Jul. 21, 2010; EP Patent No. 1939106; 12 pgs.

Satas, D.; Handbook of Pressure Sensitive Adhesive Technology; Second Edition; Van Nostrand Reinhold, New York; 1989; pp. 61-63; 84-88; and 117-119.

Translation of Official Notice of Rejection mailed on Aug. 5, 2014 in Japanese Patent Application No. 2007-249497 (6 pages).

* cited by examiner

RECLOSABLE PACKAGE

CROSS-REFERENCE TO RELATED APPLICATION

This application is a continuation of prior application Ser. No. 11/862,796 filed Sep. 27, 2007, now U.S. Pat. No. 8,596,867, which claims priority to European Patent Application no. 06027067.5 filed Dec. 29, 2006, both of which are hereby incorporated herein by reference in their entirety.

TECHNICAL FIELD

The invention relates to a reclosable package.

Particularly in the field of packages for food products it is desirable to provide the consumer with a package which is both easy to open and reclosable. With reclosable packages it is an issue that the strength of the seal is reduced with every opening and reclosing. In particular, the package might, one the one hand, be reclosable but the seal might, in the reclosed state, not be strong enough to retain parts of a product, such as crumbs or small pieces of chocolate or a relatively big, remaining part of a product, such as a chocolate bar or tablet, when only a minor portion thereof has been consumed. At the same time, when the strength of the reclosed seal is relatively high, the consumer could get the impression that the package is not in a reclosed but in the initial, not yet opened state. Therefore, it is desirable that the strength of the reclosed seal is significantly lower than the strength of the original, not yet opened seal, but high enough to provide a reliable seal in the reclosed state of the package.

RELATED ART

EP 1 288 139 A1 of the Applicant is related to a package which is easy to open and may be reclosable.

EP 1 714 895 A1 of the Applicant describes a reclosable package having a tamper evidence feature. In other words, when the package has been initially opened this is visually indicated to the consumer so that the consumer is provided with the information that there has been an initial opening and the package is not in the initial, unopened state but in a reclosed state.

As regards both of the above-mentioned packages it is to be noted that the invention described below including all of its embodiments and preferred features is applicable to the packages described in the above-mentioned documents. Thus, the disclosure of these documents, particularly regarding features of the package and the seal thereof are included herein by reference and are to be construed as subject matter of the present application.

SUMMARY OF THE INVENTION

It is an object underlying the invention to provide a package which is improved with regard to its reclosability features.

In accordance with a first solution to the above-mentioned object, a reclosable package for food products has a seal formed between a first and a second sealing portion. The sealing portions may be provided as portions of a substrate constituting the package. In other words, the substrate may appropriately be folded upon itself, so that a seal may be formed between portions thereof. In particular, the package according to the application may be provided as a so-called flow package having a so-called fin seal provided parallel to a direction of an axis, about which the substrate is folded to form the package. Moreover, end seals may be provided at the ends. In connection with the present application, one or more of the end seals and/or the fin seal may be provided with the features described below to improve the reclosability. However, only some of these seals may be formed as described below to improve the reclosability only in these areas.

The seal is formed by a cold seal applied between the first and the second sealing portion. The cold seal may be provided on the first and/or second sealing portion in a pattern. The cold seal may be an adhesive. It has been found, in connection with the present invention, that a cold seal is best suitable for providing an improved reclosability. In this context, it has particularly been found that the reclosability characteristics can be improved when a cold seal is formed between a first and a second sealing portion, in which the bonding force of the cold seal to the first and the second sealing portion is greater than the bonding force within the cold seal. This causes the cold seal to be separated when the package is opened and the seal is broken. As a consequence the cold seal partly adheres to the first sealing portion and partly adheres to the second sealing portion. This behaviour of the cold seal leads to a reclosable package having a seal which provides a sufficient, initial sealing force as well as reclosability and a sealing force after reclosing, which is high enough to retain the products or parts thereof and, at the same time, somewhat lower than the initial bonding force, so that the consumer can advantageously feel that the package is in the reclosed state.

This may be called a cohesive split and is particularly advantageous as the cold seal will reliably stay with the first and second sealing portion and will not tear an upper layer from the first or second sealing portion when the seal is opened. During manufacture, it is currently preferred to apply the cold seal both to the first and to the second sealing portion. When the package is sealed, these sealing portions are brought together, and the cold seal of both sealing portions is bonded to each other. This has been found to provide a good basis for the desired cohesive split, when the seal is broken, which leads to superior reclosability. As described in more detail below, the first and second sealing portions may be provided as portions of a substrate having various layers. When the bond between the cold seal and the top layer of the sealing portion (on which the cold seal is provided) is too high, there is the risk that the cold seal will separate the upper layer from the substrate. This is not desirable as it deteriorates the reliability of the reclosing. This reliability can particularly be ensured when part of the cold seal stays with the first, and another part of the cold seal stays with the second sealing portion so that these parts of the cold seal are brought together when the package is reclosed. In other words, the cold seal is separated with regard to its thickness. Thus, when a certain surface portion is considered, that part of the cold seal, which is closer to the first sealing portion, adheres to the first sealing portion, and that part of the cold seal, which is closer to the second sealing portion, adheres to the second sealing portion. This cohesive split takes place in at least 50%, preferably at least 70% and most preferred in 100% of the area of the cold seal. In some portions, the cold seal may completely adhere to the first or the second sealing portion, which will not deteriorate the reclosability characteristics.

Secondly, an improved reclosable package can, according to the present invention, be provided by a package having a seal with an initial opening force of 2, preferably 2.5, to 4 N/15 mm, and opening forces for one or more reclosings of 0.5 to 2 N/15 mm, preferably 1 to 1.5 N/15 mm. The given forces correspond to that force which is necessary to peel a strip of material having a width of 15 mm and being provided with the described seal. This force can, in particular, be measured in accordance with the draft for DIN 55529. The forces given have shown, firstly, to provide sufficient initial opening force, which is at the same time not so high that the consumer will have difficulty opening the package. The opening forces for the reclosed state are, firstly, high enough to retain the product or parts thereof, and, secondly, significantly lower than the initial opening force so that the consumer can feel the difference between the reclosed state and the initial, not yet opened state. The opening force may become smaller and smaller with more reclosings. However, it is currently preferred that the opening force is still above 1 N/15 mm after the fourth reclosing. Moreover, the opening force may be above 2 N/15 mm for the first reclose, provided the initial opening force is still somewhat higher, for example above 2.5 N/15 mm. The above-mentioned values have, moreover, shown to be efficient for avoiding de-lamination of the first and second sealing portions. As mentioned above, these portions will usually be provided as portions of a film-type substrate having various layers. If the bonding force between the cold seal and the top layer of the substrate is too high, there is the risk that the top layer of the substrate will be separated from the substrate together with the cold seal. As mentioned, the above values for the bonding forces prevent this undesirable situation from occurring.

The package described herein is particularly suitable for solid or pieces of food products, such as chocolate, cheese slices, which may be wrapped, biscuits, (health) food bars etc. The package described herein is also suitable for solid or pieces of non-food products, for which it is beneficial to provide an easy to open and/or reclosable package.

Finally, the reclosability characteristics can also be improved, when at least one of the first and second sealing portions has a relatively low surface roughness, in other words, is relatively smooth. This may, for example, be achieved by an acrylic coating or a primer, with which the first and/or second sealing portion may be coated. It has been found that the cold seal will undergo a so-called cohesive split when the package is initially opened. In other words, a part of the cold seal will stay on the first surface portion and a part of the cold seal will stay on the second surface portion when the seal is initially opened, i.e. when the first and second surface portions are separated. It has been found that the reclosability characteristics are particularly good when such a cohesive split is achieved. When the package is reclosed, the separated parts of the cold seal are brought together and provide a bonding force which has shown to be high enough to retain the product, as well as small pieces thereof such as crumbs, even after numerous, for example five or six reclosings. At the same time, the consumer can feel that the package is not in the initial, closed state but in a reclosed state so that a smaller opening force than used initially is required. Thus, an improved reclosable package can be provided. The reclosability is more consistent and reliable with all embodiments described herein.

As regards the desired surface roughness, the cohesive split of the cold seal as well as the desired bonding forces, respectively, it has been found in connection with the present invention that it is beneficial to coat the first and/or second sealing portion, preferably with an acrylic coating or a primer. The aforementioned coating may be applied with an amount of 0.5 to 1.5 g/m$^2$, preferably about 0.9 g/m$^2$. Tests using these values have shown advantageous characteristics.

This also applies to the preferred type of the cold seal, namely a natural latex base cold seal. For such a seal it has been found that the peel opening could be effected with a low stringing or webbing effect.

Generally, the preferred cold seal can be described to be a "hard" cold seal, as compared to a conventional "soft" cold seal, with a relatively high rubber content and a relatively low content of polymers. The high rubber content leads to an undesired stringing or webbing effect, in which strings of cold seal are separated from the sealing portions. In contrast, the preferred "hard" cold seal contains less rubber and more polymers or copolymers, particularly acrylic polymers or copolymers. In this context, a polymer/copolymer content of above 30%, preferably above 50% and even more preferred above 70% will be advantageous. It has particularly been found that a cold seal containing at least one acrylic polymer or copolymer provides good reclosability. In particular, such a type of cold seal can advantageously be combined with an acrylic coating on the first and/or second sealing portion. It has been found that this combination provides particularly good reclosability characteristics and leads to a reliable cohesive split as described above. One explanation, to which the invention is, however, not limited, is that the acrylic coating and the acrylic polymer or copolymer provide a good anchorage to each other.

In this context, it is currently preferred that the cold seal contains at least one styrene acrylic polymer or copolymer, preferably two different kinds thereof. In particular, a softer styrene acrylic polymer or copolymer may have relatively large molecules and will provide, together with the rubber, particularly a natural latex based rubber, a good initial sealing.

In particular, superior test results were obtained with a cold seal, which was a Swale grade 8113, which is, accordingly, preferred in connection with the invention.

Tests have also been conducted with regard to the most advantageous amount of cold seal applied. In this context, very good results could be obtained with an amount of 3 to 5, preferably 3.5 to 4.9 g/m$^2$ on each sealing portion.

EXAMPLE

The package according to the invention may, for example, be formed from a substrate having the following structure. The total thickness of the film constituting the substrate, on which the first and second sealing portions are provided, may be between 60μ and 70μ. Starting at the outside of the package an OPP (oriented polypropylene) flame-treated release layer having a thickness of around 3μ may be provided to avoid a blocking of the film and/or picking off of the cold seal. As the next layer towards the interior of the package, preferably a clear OPP core having a thickness of approximately 14μ, is provided for providing stiffness to the substrate, protecting the ink mentioned below which is used for applying graphic information, and providing a glossy appearance.

Next an OPP corona treated release layer of approximately 3μ is provided to promote bonding. Next an amount of 2 to 3 g/m$^2$ adhesive is provided to bind the above-mentioned OPP films.

Towards the inside of the package approximately 1 to 4 g/m$^2$ of ink is applied to display graphic information.

Next towards the inside of the package about 0.9 g/m$^2$ of acrylic coating is present as an aroma barrier and/or a surface suitable for printing thereon.

Next approximately 0.3 g/m$^2$ of primer is provided for coating adhesion. As a next layer towards the inside of the package, an OPP skin layer having a thickness of approximately 3μ is present to protect the core layer mentioned below. The core layer is, for example, formed of super white opaque cavitated OPP having a thickness of approximately 27μ to 37μ in order provide stiffness, opacity and light protection.

Towards the inside of the package another OPP skin layer of approximately 3μ is provided to protect the above-mentioned core layer. Towards the inside of the package a primer is preferably present with an amount of approximately 0.3 g/m$^2$ for coating adhesion. Next, in the preferred example, an acrylic coating is provided with an amount of approximately 0.9 g/m$^2$ to provide an aroma barrier and a surface having a good smoothness or a surface roughness below a predetermined value to provide a surface suitable for applying a cold seal pattern. The cold seal is preferably applied with an amount of about 4 g/m$^2$ to provide a seal, which is preferably easy to open and reclosable.

As regards the bonding forces, and as far as they have not yet been mentioned, the adhesion strength of the cold seal to the first and/or second sealing portion, in other words to the acrylic coating in the above example, is preferably between 4.5 and 7 N/15 mm to achieve the above-described cohesive split. Accordingly, the adhesion strength between the acrylic coating and the primer is preferably higher than the strength between the cold seal and the acrylic coating to avoid delamination, in other words to avoid the effect of the cold seal removing the acrylic coating from the substrate.

The invention claimed is:

1. A reclosable package having a cold seal formed between a first and a second sealing portion and sealing the package in an initial, unopened state, in which the bonding force of the cold seal to the first and the second sealing portion is greater than the bonding force within the cold seal, so that the cold seal is separated and partly adheres to the first, and partly adheres to the second sealing portion when the seal is opened, the cold seal also sealing the package in a reclosed state, wherein the sealing force in the reclosed state is lower than the initial sealing force, wherein the cold seal is a hard cold seal and contains at least one acrylic polymer or copolymer, said cold seal having a polymer/copolymer content of above 50%, wherein at least one of the first and second sealing portions is coated with an acrylic coating or a primer, and wherein the coating is applied with an amount of 0.5 to 1.5 grams/m$^2$.

2. The reclosable package in accordance with claim 1, having a seal with an initial opening force of 2 to 4 N/15 mm, and opening forces for one or more re-closings of 0.5 to 2 N/15 mm.

3. The reclosable package in accordance with claim 2, having a seal with an initial opening force of 2.5 to 4 N/15 mm, and opening forces for one or more re-closings of 1 to 1.5 N/15 mm.

4. The reclosable package in accordance with claim 1, wherein the coating is applied with an amount of about 0.9 grams/m$^2$.

5. The reclosable package in accordance with claim 1, wherein the cold seal is a natural latex based cold seal.

6. The reclosable package in accordance with claim 5, wherein the cold seal contains at least one styrene acrylic polymer or copolymer.

7. The reclosable package in accordance with claim 6, wherein the cold seal contains at least two different types of styrene acrylic polymers and copolymers.

8. The reclosable package in accordance with claim 1, wherein the cohesive split occurs in at least about 50% of the cross-section area of the cold seal adhesive.

9. A reclosable package having a cold seal formed between a first and a second sealing portion and sealing the package in an initial, unopened state, in which the bonding force of the cold seal to the first and the second sealing portion is greater than the bonding force within the cold seal, so that the cold seal is separated and partly adheres to the first, and partly adheres to the second sealing portion when the seal is opened, the cold seal also sealing the package in a reclosed state, wherein the sealing force in the reclosed state is lower than the initial sealing force, wherein the cold seal is a hard cold seal and contains at least one acrylic polymer or copolymer, said cold seal having a polymer/copolymer content of above 50%, wherein at least one of the first and second sealing portions is coated with an acrylic coating or a primer, and wherein the cold seal is applied with an amount of 3 to 5 grams/m$^2$ on each sealing portion.

10. The reclosable package in accordance with claim 9, wherein the cold seal is applied with an amount of 3.5 to 4.9 grams/m$^2$ on each sealing portion.

* * * * *

UNITED STATES PATENT AND TRADEMARK OFFICE

CERTIFICATE OF CORRECTION

PATENT NO. : 9,096,351 B2
APPLICATION NO. : 13/948749
DATED : August 4, 2015
INVENTOR(S) : Ron Exner et al.

It is certified that error appears in the above-identified patent and that said Letters Patent is hereby corrected as shown below:

On the title page item [57]

Line 1, delete "flood" and insert -- food --, therefor.

Line 9, delete "opened or," and insert -- opened, or --, therefor.

Line 11, before "4 N/15" delete "a".

Signed and Sealed this
Fifteenth Day of March, 2016

Michelle K. Lee

Michelle K. Lee
*Director of the United States Patent and Trademark Office*